United States Patent [19]

Doria et al.

[11] Patent Number: 4,805,333

[45] Date of Patent: Feb. 21, 1989

[54] PACK-TYPE CLIP FOR SHOTGUN CARTRIDGES

[75] Inventors: Pierluigi Doria; Sergio Mottana, both of Brescia, Italy

[73] Assignee: Luigi Franchi S.p.A., Italy

[21] Appl. No.: 52,010

[22] Filed: May 19, 1987

[30] Foreign Application Priority Data

Jun. 4, 1986 [IT] Italy ..... 22095/86[U]

[51] Int. Cl.[4] ..... F41C 25/02

[52] U.S. Cl. ..... 42/50

[58] Field of Search ..... 42/50, 18, 22

[56] References Cited

U.S. PATENT DOCUMENTS 356,277 1/1887 Diss ..... 42/18

465,339 12/1891 Browning et al. ..... 42/18

1,738,439 12/1929 Leve ..... 42/18

2,765,558 10/1956 Roper et al. ..... 42/18

*Primary Examiner*—Charles T. Jordan

*Attorney, Agent, or Firm*—Browning, Bushman, Zamecki & Anderson

[57] ABSTRACT

A pack-type clip for shotgun cartridges comprises a container of box-like construction and elongate shape with an open end and two oppositely located, respectively muzzle and breech, minor walls, as well as major side walls. On each of the major side walls, proximately of the breech side minor wall, there is formed a lengthwise guide rib, the lengthwise ribs being oppositely located to face each other and set mutually apart by a distance substantially equal to the diameter of a cartridge.

3 Claims, 4 Drawing Sheets

PACK-TYPE CLIP FOR SHOTGUN CARTRIDGES

DESCRIPTION

This invention relates to a pack-type clip for shotgun cartridges, which comprises a container of box-like construction and elongate shape with an open end, there being also defined in the container oppositely-located, respectively muzzle and breech side, minor walls and oppositely-located major side walls.

In particular, the invention is concerned with a pack-type clip for semiautomatic shotguns with either pump-, or gas-, or inertia-type recocking, or mixed type recocking, such as gas/pump, inertia/pump recocking, and so forth.

As is known, the use of pack-type clips affords a number of well-recognized favorable aspects over the traditional tubular magazine incorporated to the shotgun itself. In fact, with the pack-type clip wherein the shotgun cartridges can be packed close against one another in stacked relationship, the cartridge reloading and replacement operations are greatly simplified and much more quickly performed.

However, the problem is frequently encountered with conventional cartridge clips that, as a consequence of the firing kick, the rims provided on the cartridge bottoms tend to jump over one another. This results, when a cartridge is to be drawn out of the clip, in the operation being hindered by the rim of the next cartridge still in the clip interfering with the rim of the cartridge being drawn out of the clip, and consequently in a jammed shotgun. In addition, this same situation may arise, as will be appreciated, from careless insertion of the cartridges into the pack-type clip.

It is the object of this invention to provide a pack-type clip for shotgun cartridges which has such structural and functional features as to overcome the above-mentioned prior problems.

This object is achieved, according to the invention, by a pack-type clip as indicated being characterized in that it comprises a respective guide rib formed lengthwise on each said major side walls proximately of said breech side minor wall, said lengthwise ribs being in oppositely located and confronting relationship and set mutually apart by a distance substantially equal to the diameter dimension of said cartridges.

Advantageously, the pack-type clip of this invention further comprises a respective transverse guide rib formed across each said major side walls proximately of the container open end and merging continuously with an adjoining end of a respective one of said lengthwise ribs, said transverse ribs being oppositely located to face each other and set mutually apart by a distance substantially equal to the diameter dimension of said cartridges.

Further features and the advantages of the cartridge clip according to the invention will become apparent from the following description of a preferred exemplary embodiment thereof, given by way of illustration and not of limitation with reference to the accompanying drawings. In the drawings.

Figure 1:
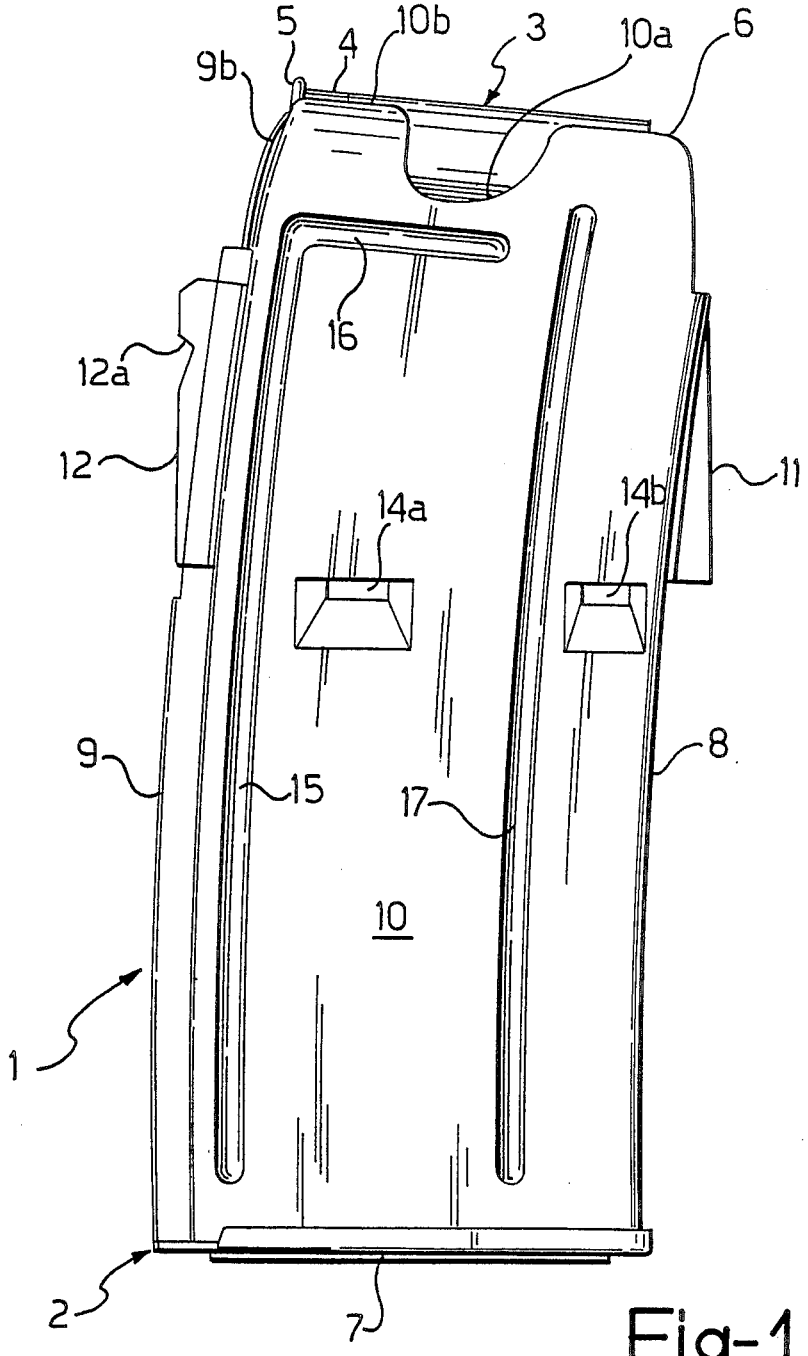
FIG. 1 is a side elevation view showing schematically a pack-type cartridge clip according to the invention.
Figure 2:
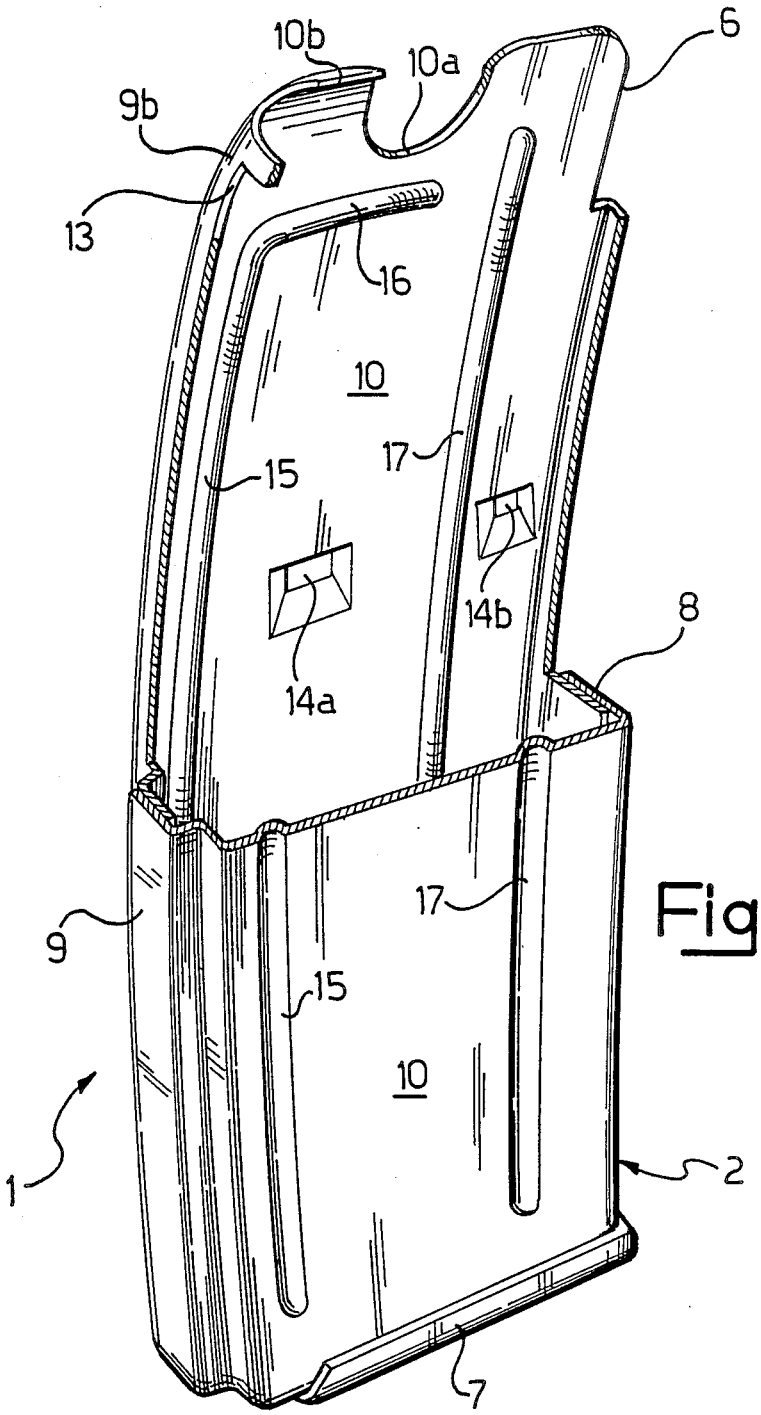
FIG. 2 is a perspective view showing a detail of FIG. 1 part-sectioned and to an enlarged scale.
Figure 4:
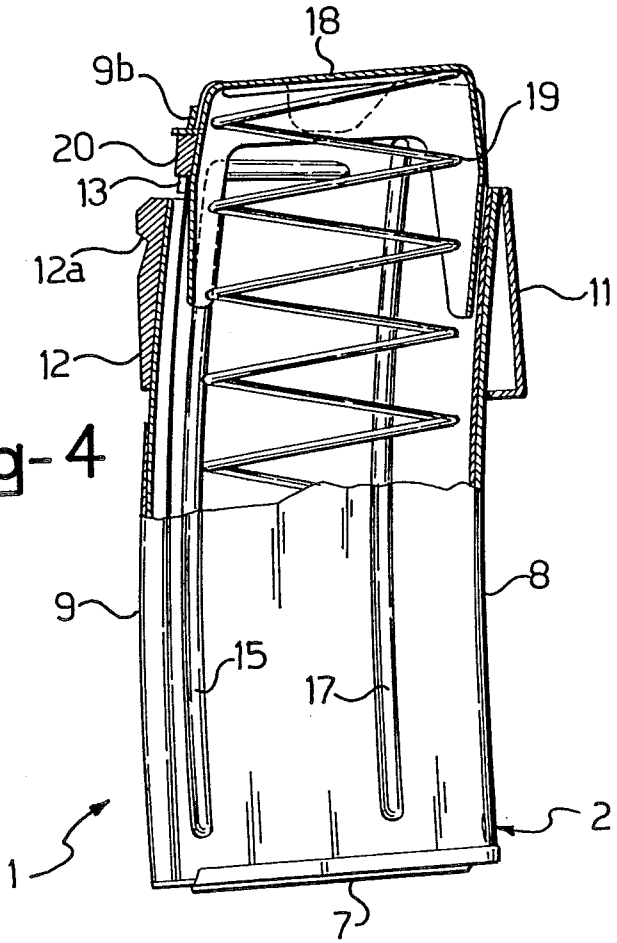
Figure 3:
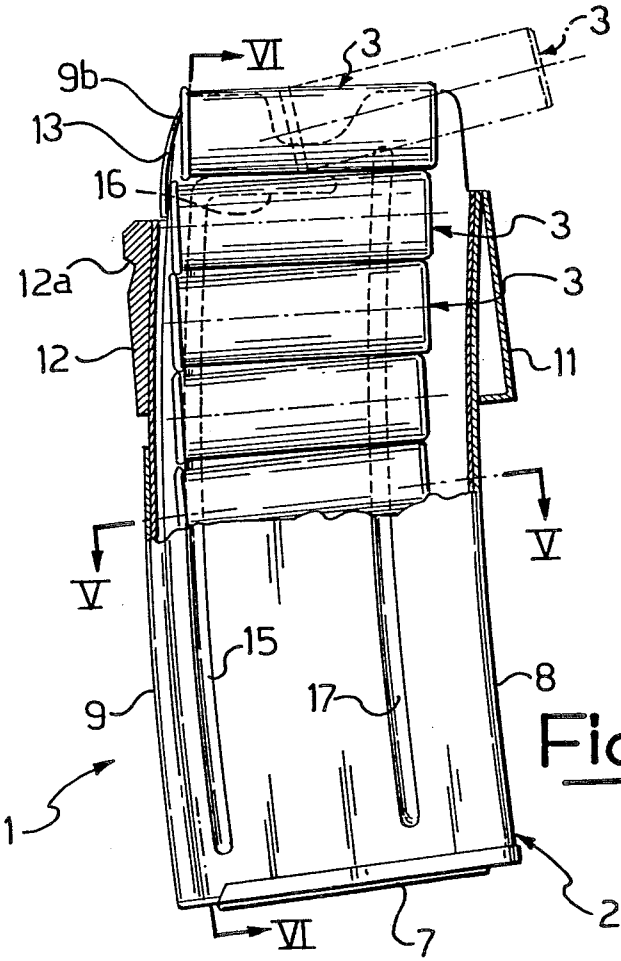
Figure 6:
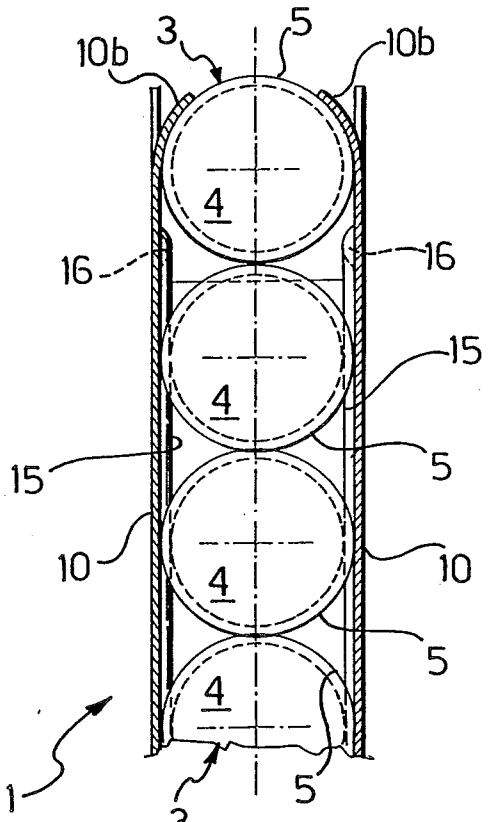
Figure 5:
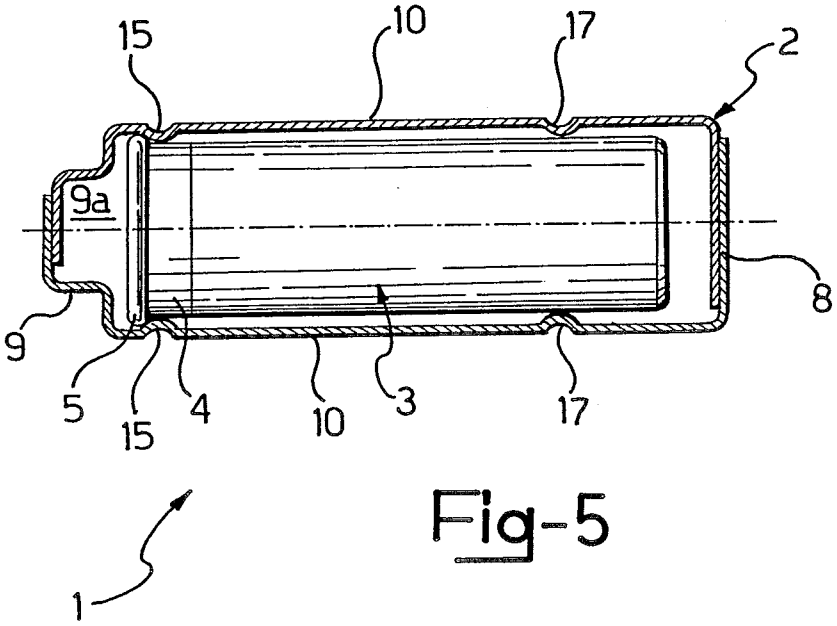

FIGS. 3 and 4 part-sectional reduced scale side views of the cartridge clip of FIG. 1, respectively shown fully loaded with shotgun cartridges and empty;

FIG. 5 is an enlarged scale view of the section taken along the line V—V in FIG. 3; and FIG. 6 is a fragmentary view of the enlarged scale section taken along the line VI—VI in FIG. 3.

With reference to the drawing figures, the numeral 1 designates generally a pack-type clip for shotgun cartridges intended for use with semiautomatically operated shotguns.

The cartridge clip 1 comprises a metal container 2 of box-like construction and elongate shape with a substantially rectangular cross-sectional shape, it being adapted to contain, as explained hereinafter, a plurality of conventional shotgun cartridges 3 having respective bottoms 4 formed with rims 5.

The container 2 has an open end 6 and opposite end provided with a stopper 7 which is attached to the container 2 removably and forms the bottom thereof. Furthermore, within the container 2 there are defined oppositely located minor walls, respectively a muzzle side wall 8 and breech side wall 9, and major side walls, both designated 10.

The muzzle side minor wall 8 has a guide lug 11 of triangular shape in longitudinal section, which is adapted to fit in a correspionding portion of a shotgun stock, not shown because quite conventional.

The breech side minor wall 9 is in turn provided, at a location corresponding with that of the guide lug 11 on the wall 8, with a stop lug 12 on which a ledge **12*a* is formed for engagement with a conventional lock lever of said shotgun, thereby to hold the pack-type cartridge clip 1 within the gun stock. Furthermore, the breech side minor wall 9 is configured to define a seat 9*a* lying lengthwise of the container 2** and facing inwards thereof.

The breech side minor wall 9 advantageously includes an end section **9*b* extending between the stop lug 12 and the open end 6 of the container 2, and this end section 9*b* is bent to a preset radius of curvature toward said open end 6**.

A slot 13 is cut lengthwise in the end section **9*b* which extends substantially aligned to the seat 9*a* formed in breech side minor wall 9**.

Two slots **14*a*, 14*b* are cut in each side wall 10 at substantially intermediate locations between the stopper 7 and the open end 6**.

A respective cutout **10*a* is formed in the major side walls 10 at the open end 6; further, and also at the end 6, each major side wall 10 is provided, between the cutout 10*a* and the end section 9*b*, with a detent tab 10*b* formed integrally with the wall and being bent to an arc of a circle having substantially the same diameter as the shotgun cartridges 3, each tab 10*b* merging with the end section 9*b***.

In accordance with the invention, the pack-type clip 1 includes a respective guide rib 15 formed, such as by deep drawing or press forming, on each major side wall 10 in the proximity of and parallel to the breech side minor wall 9. Said lengthwise ribs 15 are arranged juxtaposed to each other, and to face the interior of the container 2, being set mutually apart by a distance which is substantially equal to the diameter dimension of the shotgun cartridges 3.

It is important to observe that the lengthwise ribs 10 are separated from the breech side minor wall 9 by a distance set by the thickness of the rim 5 of the shotgun cartridges 3, which distance would exceed the dimension of said thickness but be less than twice its dimension.

Advantageously, a respective transverse guide rib 16 is formed across each said major side walls 10 proximately of the open end 6. At a rib section confronting the breech minor wall 9, each transverse rib 16 merges continuously with an adjoining end of its respective lengthwise rib 15. Like the lengthwise ribs 15, the transverse ribs are juxtaposed, face each other, and are separated by a distance substantially equal to the diameter of the cartridges 3.

Second lengthwise ribs 17, entirely similar to the lengthwise ribs 15 and lying parallel thereto, are formed on respective major side walls in the vicinity of the muzzle minor wall 8.

The pack-type clip 1 further includes an elevator 18 guided movingly within the container 2 and being configured substantially as a rectangular bowl whose concave side faces the stopper 7; the elevator 18 is subjected to the bias force of a spring 19 of preset elasticity which is associated with the elevator 18 at one end, and with the stopper 7 at the other end.

A dog 20 is attached cantilever-fashion to the elevator 18 on a side thereof which extends in the vicinity of the upright muzzle side minor wall 9. Said dog 20 fits slidingly into and is guided along the lengthwise seat 9*a* and the slot 13.

It should be noted that the dog 20, when inserted through the slot 13, would project outwards from the pack-type clip 1 and engage, in a manner known per set, a lever, not shown, provided in the shotgun for holding a conventional breechblock in its open position.

The pack-type cartridge clip 1 is loaded with a number of shotgun cartridges 3 by inserting one cartridge at a time through the open end 6 of the container 2, thus overcoming the force of the spring 19 opposing the downward movement of the elevator 18. In particular, each cartridge 3 would be introduced into the clip 1 with its bottom 4 facing the breech side minor wall 9, and slid along the transverse guide ribs 16 until its rim 5, as guided by the end section 9*b*, fits in between the lengthwise guide ribs 15 and the breech side minor wall 9, a cartridge being urged by the next toward the bottom stopper 7 until the pack-type clip 1 is fully loaded.

On firing, each shotgun cartridge 3 is pushed into the cartridge chamber directly by the aforesaid shotgun breech block, the procedure being the reverse of that described for loading the cartridge clip 1.

It should be noted that with the pack-type cartridge clip of this invention, the bottom rims of the shotgun cartridges inserted therein are readily guided by the guide ribs and held at all times strictly in stacked relationship on top of one another. Accordingly, any possibility of the rims jumping over one another—i.e. of one rim locating itself in front of the following one, to thus hinder extraction of its corresponding shotgun cartridge from the pack-type clip—is eliminated.

A further advantage of the cartridge clip according to the invention is that it can even accommodate shotgun cartridges of different lengths without this militiating against the proper operation of the cartridge clip and the feed mechanism of a shotgun.

I claim:

1. A pack-type clip for shotgun cartridges, comprising a container of box-like construction and elongate shape with an open end, there being also defined in the container oppositely located, respectively muzzle and breech side, minor walls and major side walls, characterized in that it comprises a respective guide rib formed lengthwise on each said major side walls proximately of said breech side minor wall and projecting into said clip, said lengthwise ribs being in oppositely located and confronting relationship, being set mutually apart by a distance substantially equal to the diameter dimension of said cartridges forward of their rims, and being spaced from said breech side minor wall by a distance greater than the thickness of the rims of said cartridges but less than or equal to about twice said thickness.

2. A pack-type clip according to claim 1, characterized in that it comprises a respective transverse guide rib formed across each said major side walls proximately of the container open end and merging continuously with an adjoining end of a respective one of said lengthwise ribs, said transverse ribs being oppositely located to face each other and set mutually apart by a distance substantially equal to the diameter dimension of said cartridges

3. A pack-type clip according to claim 2, characterized in that an end section of said breech side minor wall is bent to a preset radius of curvature toward said container open end (6).

* * * * *